US006526339B1

(12) United States Patent
Herzog et al.

(10) Patent No.: US 6,526,339 B1
(45) Date of Patent: Feb. 25, 2003

(54) GPS CONTROLLED MULTIPLE SOURCE MATERIAL APPLICATION

(75) Inventors: Stanley M. Herzog, St. Joseph, MO (US); Ronald A. Schmitz, Clarksdale, MO (US); Ivan Eugene Bounds, St. Joseph, MO (US); Randy L. Poggemiller, Easton, MO (US); Stephen L. Bedingfield, Savannah, MO (US); Patrick R. Harris, Lenexa, KS (US); Daniel B. Laughlin, Kansas City, MO (US)

(73) Assignee: Herzog Contracting Corp., St. Joseph, MO (US)

( * ) Notice: Subject to any disclaimer, the term of this patent is extended or adjusted under 35 U.S.C. 154(b) by 0 days.

(21) Appl. No.: 09/659,443

(22) Filed: Sep. 8, 2000

Related U.S. Application Data

(63) Continuation-in-part of application No. 09/285,290, filed on Apr. 2, 1999.

(51) Int. Cl.[7] ..... G05D 1/00; G01C 21/00; G06F 19/00; B61L 1/02; B61D 3/00

(52) U.S. Cl. ..... 701/19; 701/50; 701/207; 701/213; 701/214; 246/127; 105/311.1; 221/92; 222/482; 222/129

(58) Field of Search ..... 701/207, 213, 701/214, 215, 19, 50; 246/127; 105/311.1; 221/92, 94, 124; 222/481, 482, 129

(56) References Cited

U.S. PATENT DOCUMENTS

| | | | | | |
|---|---|---|---|---|---|
| 3,838,649 | A | * | 10/1974 | Barnard | 105/240 |
| 3,942,448 | A | | 3/1976 | Unbehaun et al. | 104/11 |
| 4,102,066 | A | | 7/1978 | Christoff | 37/104 |
| 4,108,076 | A | * | 8/1978 | Knape | 104/2 |
| 4,114,155 | A | | 9/1978 | Raab | 342/394 |
| 4,445,118 | A | | 4/1984 | Taylor et al. | 342/357.09 |
| 4,500,037 | A | | 2/1985 | Braitsch et al. | 238/2 |
| 4,751,512 | A | | 6/1988 | Longaker | 342/357.03 |
| 4,918,690 | A | | 4/1990 | Markkula, Jr. et al. | 370/400 |
| 5,284,097 | A | * | 2/1994 | Peppin et al. | 105/311.1 |
| 5,323,322 | A | | 6/1994 | Mueller et al. | 701/215 |
| 5,390,125 | A | * | 2/1995 | Sennott et al. | 701/214 |
| 5,437,232 | A | * | 8/1995 | Borowski | 104/2 |
| 5,574,469 | A | | 11/1996 | Hsu | 342/455 |
| 5,657,700 | A | | 8/1997 | Bounds | 105/311.1 |
| 5,737,221 | A | * | 4/1998 | Newton | 221/124 |
| 5,740,547 | A | | 4/1998 | Kull et al. | 701/19 |
| 5,907,914 | A | * | 6/1999 | Theurer | 104/2 |
| 6,073,561 | A | * | 6/2000 | Theurer et al. | 104/7.3 |
| 6,161,986 | A | * | 12/2000 | Smith et al. | 404/75 |
| 6,246,938 | B1 | * | 6/2001 | Giletta et al. | 342/357.17 |

* cited by examiner

*Primary Examiner*—Jacques H. Louis-Jacques
*Assistant Examiner*—Brian J Broadhead
(74) *Attorney, Agent, or Firm*—Shook, Hardy & Bacon L.L.P.

(57) ABSTRACT

A GPS controlled multiple source material application or ballast spreading system includes tracking the position of a plurality of ballast hopper cars using GPS derived coordinates and controlling the opening of multiple ballast doors to spread ballast on desired sections of track for railroad maintenance. The process involves tracking the current hopper loads, the opened or closed state of the ballast doors, and the concurrent amount of ballast which has been spread on the desired track sections.

12 Claims, 14 Drawing Sheets

233
Z
252
REQUEST NID ?
Y
N
RETURN NEURON ID
253
REQUEST CAR STATUS ?
Y
N
RETURN CAR STATUS
254
REQUEST CAR DATA ?
Y
N
RETURN CAR SENSOR DATA
X

CAPTURE ALL NID'S
282
286
BROADCAST "OPEN FRONT RELAY"
280
288
ANY RESPONDING CCU?
Y
N
CAPTURE RESPONDING CCU AS REVERSED CAR; SET RESPONDING CCU TO NO-RESPONSE MODE
290
284
WAIT RELAY TIMEOUT
300
BROADCAST " OPEN REAR RELAY"
292
296
ANY RESPONDING CCU?
Y
N
294
CAPTURE RESPONDING CCU AS FORWARD CAR; SET RESPONDING CCU TO NO-RESPONSE MODE
298
ALL NID ORIENTATIONS DETECTED ?
N
Y
STORE AS MANIFEST DATA FILE
302

GPS CONTROLLED MULTIPLE SOURCE MATERIAL APPLICATION

CROSS-REFERENCE TO RELATED APPLICATION

This is a continuation-in-part of copending U.S. patent application, Ser. No. 09/285,290 for LOGISTICS SYSTEM AND METHOD WITH POSITION CONTROL filed Apr. 2, 1999 which is incorporated herein by reference.

FIELD OF THE INVENTION

The present invention relates generally to logistics and, more particularly, to a GPS based system for spreading ballast along railroad tracks for track maintenance.

BACKGROUND OF THE INVENTION

Conventional railroads in the United States and elsewhere are typically formed by a compacted sub-grade, a bed of gravel ballast, wooden cross-ties positioned upon and within the ballast, and parallel steel rails secured to the ties. Variations of construction occur at road and bridge crossings and in other circumstances. The ballast beneath and between the ties stabilizes the positions of the ties, keeps the rails level, and provides some cushioning of the composite structure for loads imposed by rail traffic. Vibrations from the movement of tracked vehicles over the rails and weathering from wind, rain, ice, and freeze and thaw cycles can all contribute to dislodging of some of the ballast over time. Thus, in addition to other maintenance activities, it is necessary to replace ballast periodically to maintain the integrity and safety of railroads.

Conventionally, ballast is spread using specially configured ballast hopper cars which include a hopper structure holding a quantity of ballast, a ballast chute communicating with the hopper, and a motorized ballast discharge door in the chute. The door can be controlled to selectively open or close to control the discharge of ballast. In some designs, the discharge door can be controlled to open outboard toward the outside of the rails, to close, or to open inboard toward the inside between the rails. Typical ballast hopper cars have a front hopper and a rear hopper, and each hopper has two transversely spaced doors, one to the left and one to the right. Thus, each hopper door can be controlled to discharge ballast outside the rails on the left and/or the right or between the rails. A typical configuration of a ballast hopper car is described in more detail in U.S. Pat. No. 5,657,700, which is incorporated herein by reference.

In general, ballast spreading has been controlled manually in cooperation with spotters who walk alongside the moving ballast cars to open or close the ballast doors as necessary. A more recent ballast spreading control technique is by the use of a radio linked controller carried by an operator who walks alongside the moving ballast cars. Both conventional control methods are so slow as to disrupt normal traffic on the railroad section being maintained, thereby causing delays in deliveries and loss of income.

Copending application, Ser. No. 09/285,290, generally discloses methods for spreading railroad ballast with location control based on data received from the global positioning system or GPS. The GPS system, also referred to as NAVSTAR, is a "constellation" of satellites traveling in orbits which distribute them around the earth, transmitting location and time signals. As originally designed, a GPS receiver, receiving signals from at least four satellites, was able to process the signals and triangulate position coordinates accurate to about ten to twenty meters. Current generations of commercially available GPS receivers, using differential GPS techniques, are able to achieve accuracies in the range of one to five meters. Such accuracy is adequate for depositing ballast where desired and inhibiting the deposit of ballast where it is not desired. Additional information regarding the development of GPS technologies can be obtained from U.S. Pat. Nos. 4,445,118 and U.S. Pat. No. 5,323,322 which are incorporated herein by reference. Development of the GPS system referred to herein was sponsored by the United States government. However, satellite based positioning systems developed or operated by other nations are also known.

Because railroad companies typically maintain hundreds or thousands of miles of track on a recurring schedule, the ballast replacement component of track maintenance alone can be a major undertaking in terms of equipment, materials, traffic control, labor, and management. Knowing the ballast capacity of the hoppers of a ballast car and the flow rate through the ballast doors, it would be possible to provide each ballast car with a GPS receiver, to program an individual on-car computer with a set of spread coordinates and ballast distribution parameters, and to control the flow of ballast in a spread zone in relation to measured or computed car speed. However, such an approach would be expensive in terms of GPS receivers and control computers and would be extremely laborious for a large project. Additionally, coordination and record keeping would be complicated by such a piecemeal approach.

SUMMARY OF THE INVENTION

The present invention provides methods and apparatus for controlled spreading of ballast on a railroad on a large scale basis using multiple ballast hopper cars spreading simultaneously, at times. The system of the present invention uses location coordinates provided by a differential GPS receiver to coordinate the opening of ballast doors to spread controlled quantities of ballast on sections where ballast is desired and to inhibit spreading ballast where not desired or not needed. The system allows the ballast train to spread ballast mostly at a high enough speed that normal traffic on the railroad on which it is operating is only minimally affected by its presence.

In practice of the present invention, a ballast train includes one or more locomotives, a control car, and a plurality of ballast hopper cars, such as fifty hopper cars. Each hopper car has two hoppers, left and right ballast chutes for each hopper, a ballast door for each chute, and a hydraulic actuator for each door. The actuator can be controlled to open its associated door to an inboard direction, between the rails, or to an outboard direction, outside of the rails. Each hopper can hold a known load of a particular type of ballast, and the average flow rate of a given type of ballast through a ballast door is also known. Each hopper car has car logic circuitry, referred to as a car control unit or CCU and also as a "neuron", which controls operation of the hydraulic actuators and which monitors certain functions on the car.

The CCU's communicate with a central control or head end controller (HEC) through a network including a bus referred at places herein as a "wireline". The bus extends from the HEC through the CCU of each car, interrupted by a set of a front and a rear communication relay in each CCU, which is controlled by the local CCU. The communication relays can be used to determine the orientation of each car by a procedure which will be detailed below. The HEC may be a general purpose type of computer, such as a laptop, and has a differential GPS receiver interfaced thereto to provide geographic coordinates. The GPS receiver includes a GPS antenna, the location of which forms a reference location or datum for the train. The relative location of each ballast door on each hopper car of the train will be determined in relation to the reference location. Ordinarily, the ballast train will use a plurality of virtually identical hopper cars with known distances between the ballast doors on a given car and between the ballast door of one car and the next adjacent car.

In order to control the spreading of ballast on a length of track, it is necessary to obtain the geographic coordinates of the track. This is most conveniently accomplished by a survey run on the track using a road vehicle equipped with flanged wheels for traveling on rails, such as a Hy-Rail vehicle (trademark of Harsco Technologies Corporation). The track survey vehicle is equipped with a differential GPS receiver and a computer, which may be the HEC computer, and track survey software. As the survey vehicle travels along the track, the survey crew, which may be or include a "roadmaster", marks spread zones where ballast is to be spread and non-spread zones, such as bridges, road crossings, and the like, where ballast is not to be spread. In some circumstances, it may be necessary for the survey crew to stop the survey vehicle, get out with a portable GPS receiver and computer, and acquire the needed coordinates on-foot. In circumstances where multiple short spread and non-spread zones occur, it may not be possible for the hydraulic actuators to act quickly enough to accurately deposit and inhibit depositing the ballast. In such a case, the entire zone is marked for conventional ballast spreading.

Alternatively, other procedures for determining the spread and non-spread coordinates are foreseen. For example, if a previously obtained track coordinate data file is available, it is foreseen that it could be processed to designate spread and non-spread zones. Further, under some circumstances, track surveying may even conducted on a ballast train, forward of concurrent ballast spreading activity. Under normal circumstances of pre-spread surveying, a track survey data file is created which is transferred to the HEC computer for processing during a ballast spreading run.

In addition to surveying the track for its coordinates to thereby locate zones requiring ballast and those on which ballast is not desirable, it is necessary to survey the ballast train for car identities car order, and car orientation. Each car control unit or CCU includes a designated front communication relay and a designated rear communication relay, both of which are normally closed, that is, normally in a state which maintains communication continuity through the network bus. The relays are individually controllable by the CCU. The CCU is programmed to allow the relays to reclose after a certain timeout if not instructed otherwise. The hopper cars can be assembled into the ballast train in any random order and with some cars oriented front to rear while the rest are oriented rear to front. It is not economically feasible to assemble the ballast train in any particular order or to change the orientation of any particular car. However, the HEC must determine the order and orientation of the cars to enable communication of ballast door commands to the proper car during ballast spreading.

In the present invention, the process of surveying the CCU's of the hopper cars is referred to as manifesting. In the manifesting process, the HEC queries the CCU's to report their identities or neuron identification numbers. Then, through an iterative procedure of commanding the cars to open their front and then rear communication relays and report their identities, the HEC is able to determine the order of the cars and their orientations. In particular, after the identities are determined, the HEC broadcasts a command for all cars to open their front relays. Then the HEC calls for any car to identify itself. If the first car in line is forwardly oriented, no car will respond since the front relay being opened, temporarily breaks communication between the HEC and the first car's CCU. However, if a car identifies itself, the first car must be reversed in orientation since its still closed rear relay maintains communication between the HEC and the first car's CCU. The car CCU, so identified, is then placed in a no-response mode for the duration of the manifesting procedure. If the first did not respond to the first query with all front relays opened, after a communication relay timeout, all rear relays are commanded to be opened. Now the first car can be identified and determined to be forwardly oriented and is placed in a no-response mode. In a similar manner, the order and orientation of the remaining hopper cars is determined until successive queries with front and rear relays opened fails to receive a response. The data file of identified, ordered, and oriented hopper cars is stored as the manifest data file.

In the present invention, the spreading of ballast is controlled in terms of the amount or weight of ballast spread per unit of track length. Overall, from historic experience and for accounting purposes, the required quantity of ballast is determined in tons per mile. While such a scale is more convenient for determining the cost of the operation, it is too coarse for dynamic control of ballast spreading at a relatively high traveling speed. In the present invention, the track length is divided into "buckets" which are "filled" to achieve an overall desired tons of ballast per mile. The length of th e buckets may be any convenient length and, in the present invention, are set at one foot lengths of track. Since each ballast door can spread either to the inboard side or the outboard side, but not both simultaneously, the track may be divided into an inboard set of buckets and an outboard set, which must be tracked separately. Each bucket has designated coordinates which may include the GPS coordinates of a set of buckets along with a sequential member of such a set. The bucket coordinates are derived by processing a previously generated track survey file.

The spreading process of the present invention tracks the current location of the ballast train reference point in terms of its "bucket" location, the current load of ballast in each car, the fill percentage of each bucket, the state of each door as closed or opened and in which direction, and the speed of the train. Because of the lag in response of the ballast door actuators and the movement of the ballast and because of the movement of the train, the spreading process must "look ahead" in order to effectively correlate a door state to a given bucket. The spreading process is timer driven and begins executing a series of actions at each timer interval or "tick". In the present invention, the timer interval is at 100 milliseconds or one tenth of a second. Spreading actions are affected by the speed and location of the train and, thus, all calculations factor in the speed and location. In contrast, the flow rate of ballast through a ballast door can generally be considered to be a constant. Preferably, the ballast doors are operated in such a manner as to be considered fully closed or fully open; however, the present invention foresees the capability of operating with the ballast doors in partially open states.

Generally, at each clock tick, the state of each ballast door in succession is checked along with a "lookahead" set of buckets and, if the door is currently open, the fill percentage of a current bucket set of buckets which will receive ballast from the door in the current time interval. If the door is closed, the state of the lookahead bucket set is checked to determined if opening the current door will exceed the target fill of those buckets. If not, the current door is opened. If the current door is already open, the fill percentages of the current bucket set are updated, and the lookahead bucket set is checked to determine if the current fill exceeds the target fill. If not, the door stays open.

In general, the threshold to keep a door open is not as strict as the threshold to open a closed door. In zones where spreading is desired, it is preferable to spread somewhat more than the target fill than less. Subsequent maintenance activity involves crews who will properly position the ballast and tamp it into place. Thus, a small excess of ballast is preferable to an inadequate amount. However, in the case of a no-spread zone, any ballast which is deposited may constitute a hazard, such as on a road crossing, and may require a clean-up. For processing purposes, buckets in no-spread zones are initialized as full so that lookahead routines which encounter them always require the current door to close if open or to remain closed.

The spreading process continues until all buckets of a spreading run are filled, all ballast from the hopper cars is exhausted, until the process is interrupted by a detected malfunction in the system, or until the operator shuts the process down for any reason. Generally, ballast is supplied from the forwardmost hopper cars initially, moving rearwardly as the ballast is exhausted from the forward cars. If functions on a hopper car are inoperative, the car is simply bypasses in processing, although it may be necessary to bridge the computer network across such a "dead" car. It is possible that some buckets, particularly near the end of a spreading run, will not be completely filled. Thus, it is desirable to save data representing the final state of any unfilled buckets for a future spreading run. It may also be desirable to save the final state of all buckets and hopper cars for record keeping and accounting purposes.

While the ballast spreading system of the present invention preferably uses location data provided by the GPS system, it is recognized that there are locations in which a GPS receiver will not be able to acquire data from enough satellites to determine position, such as in a tunnel or in some valleys and canyons. The present invention has the capability of supplementing the GPS derived location data with location derived from detecting car wheel rotation. The present invention is adapted to track wheel rotation for a limited distance from the last good GPS data set without significant error.

Although the present invention is described and illustrated principally with reference to spreading ballast on railroads, it is foreseen that the present invention could also find application in other endeavors, such as in agriculture, road building or maintenance, or the like. Thus, the present invention is not intended to be strictly limited to applications in ballast spreading railroad maintenance.

OBJECTS AND ADVANTAGES OF THE INVENTION

The principal objects of the present invention are: to provide an improved logistics management system and method; to provide such a system and method which utilize differential enhancements of a satellite based global positioning system (GPS), such as the NAVSTAR GPS, for location determination; to provide such a system and method which are adaptable to various types of vehicles and sets of interconnected vehicles; to provide such a system and method which are adapted for use in conjunction with bulk material distributing and spreading operations; to provide such a system and method which are adapted for use with various conventional position determining systems in addition to GPS derived location determination; to provide such a system and method which utilize commercially available GPS equipment; to provide such a system and method which utilize a computer mounted on-board a vehicle with GPS location data input for controlling the distribution of a bulk material along a surface; to provide, particularly, a system and method for spreading ballast along a railroad; to provide such a system employing a plurality of ballast hopper cars, each with a pair of ballast hoppers and associated ballast doors with hydraulic actuators operating the doors to control the flow of ballast from the hoppers; to provide such a system in which each hopper car has a car controller unit (CCU) communicating with a head end controller (HEC) to receive commands to open and close the ballast doors; to provide such a system including a differential GPS receiver positioned on a ballast train including the hopper cars which concurrently detects geographic coordinates of a reference location on the train; to provide such a method which includes surveying a track on which ballast is to be spread using a GPS receiver to collect periodic coordinates of the track and wherein track zones are designated as spread zones or no-spread zones, as appropriate, to generate a track survey data file; to provide such a method including computer controlled querying of the CCU's of the hopper cars in such a manner as to determine the order and orientation of each hopper car of the train to generate a manifest data file for the particular ballast train; to provide such a method which controls the spreading of ballast on a railroad by dynamically tracking the position of a reference location on the ballast train, the current amount of ballast which already been spread on sections of the track, the remaining ballast load of each hopper car, and the state of each ballast door and, generally, opening a given ballast door or maintaining it open if the ballast spreading therefrom will not exceed a target amount of ballast per unit of track length and closing or maintaining the door closed if the target ballast in a given location would be exceeded; to provide such a system and method which can reduce the time and labor required for a large proportion of ballast maintenance on railroads; to provide such a system of ballast spreading which minimizes the disruption of normal traffic on a railroad; to provide such a system and method which are adaptable for use with various discharge control means in connection with ballast spreading operations; and to provide such systems and methods of ballast spreading which are economical to practice, which are efficient in operation, and which are particularly well adapted for their intended purposes.

Other objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

Figure 1:
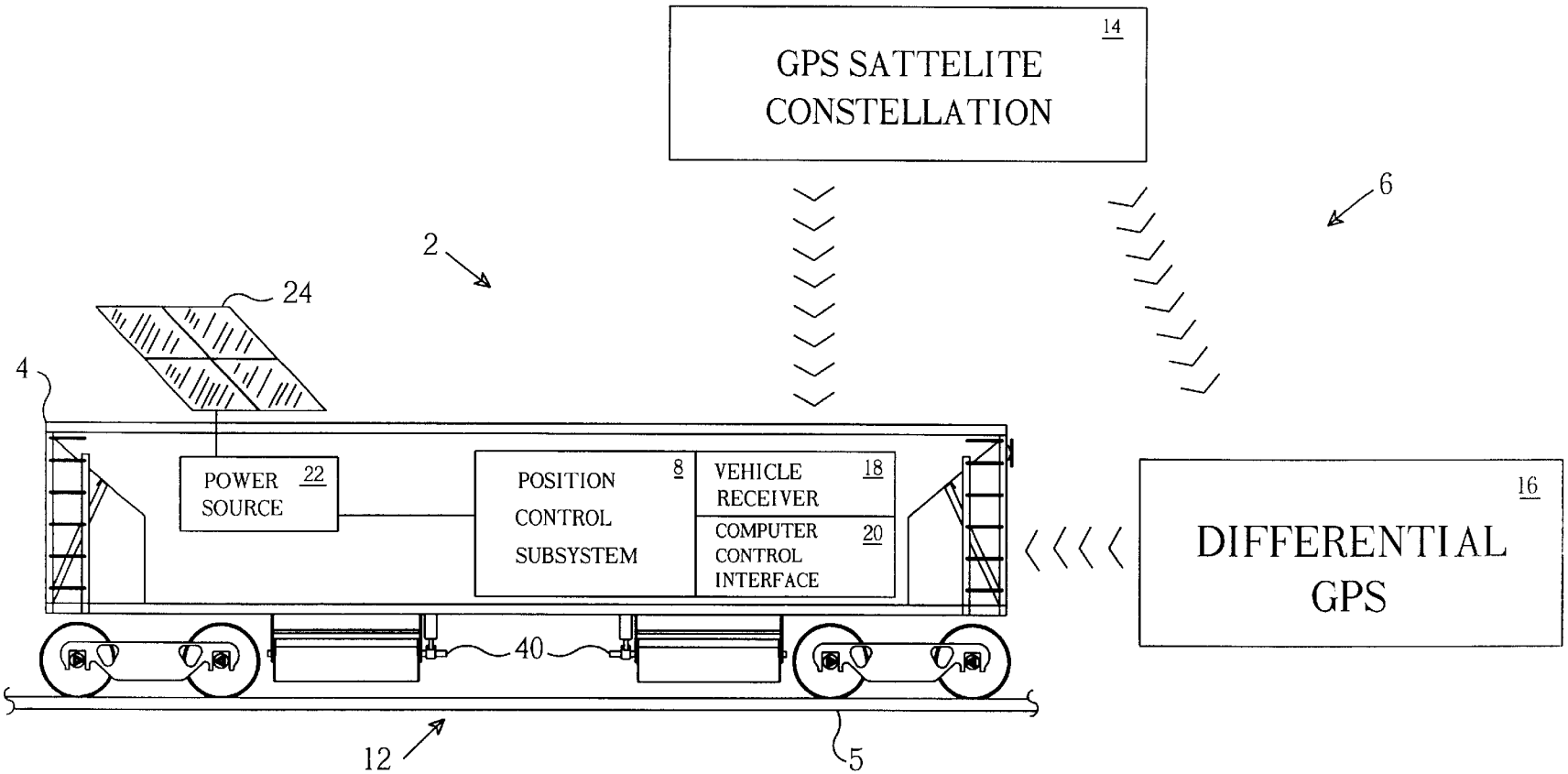
FIG. 1 is a diagrammatic view of a GPS controlled material spreading system embodying the present invention, shown implemented as a ballast spreading system installed on a railcar.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a GPS controlled multiple source material application system embodying the present invention. The system 2 is also referred to herein as a ballast spreading system. Without limitation on the generality of useful applications of the system 2, it is shown installed on a ballast train 3 (FIG. 14) including a plurality of ballast hopper cars 4 for ballast spreading operations.

Figure 4:
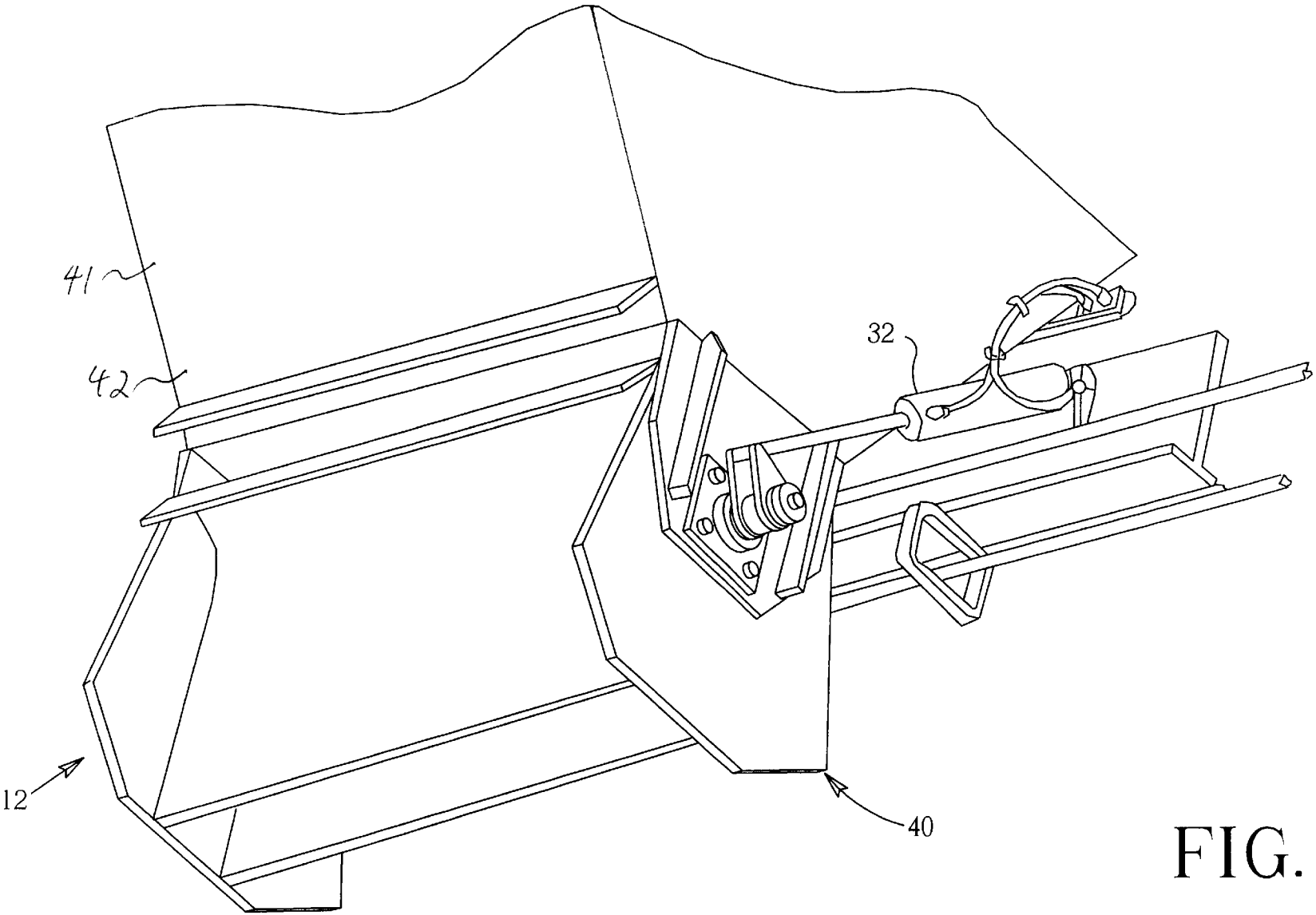
FIG. 4 is an enlarged fragmentary perspective view of a ballast discharge control mechanism including a ballast door and hydraulic actuator therefor thereof.
Figure 5:
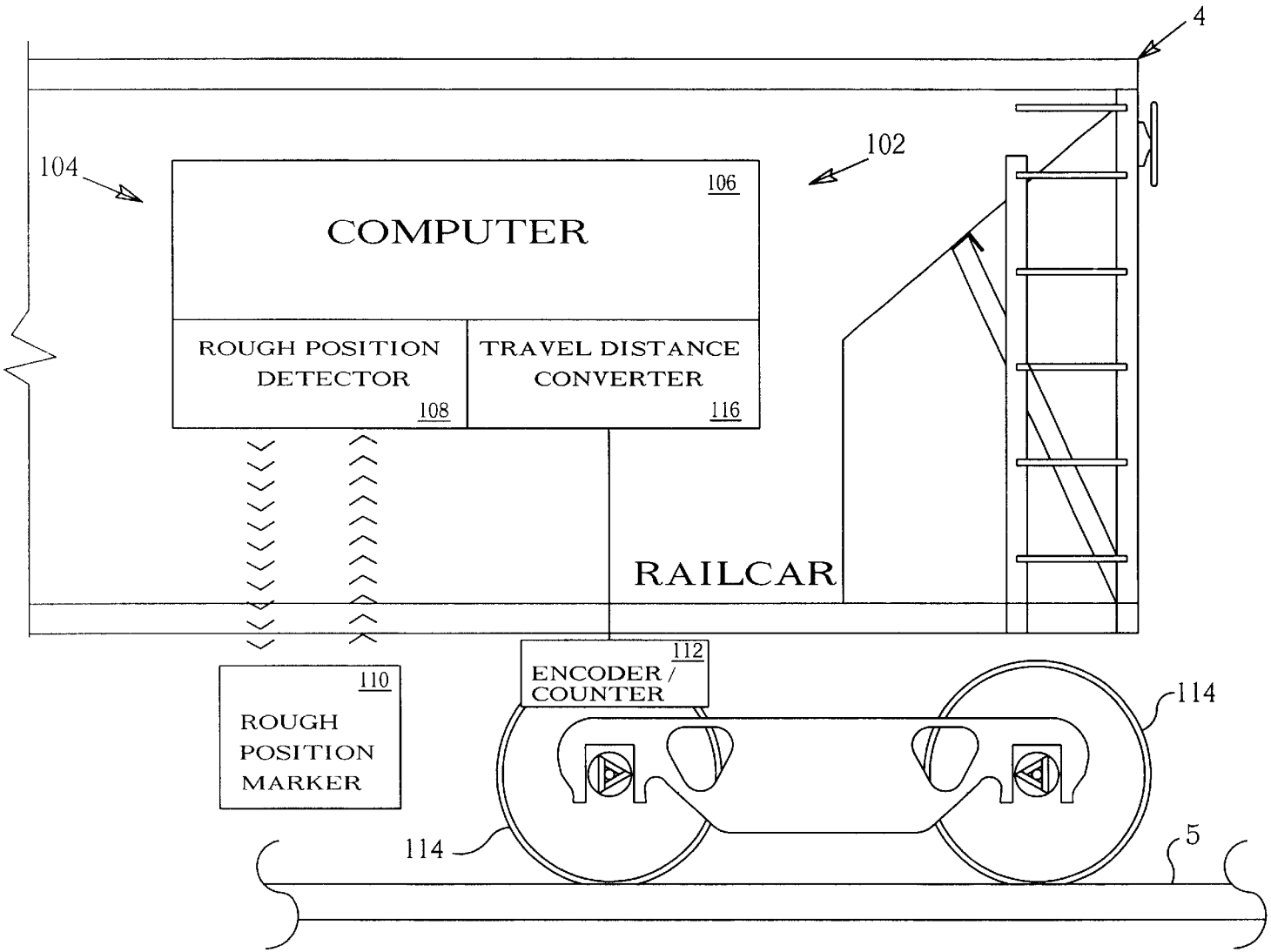
FIG. 5 is a diagrammatic view illustrating principal components of an alternative modified embodiment of a position control subsystem for use in present invention.

The system 2 generally makes use of a satellite based global positioning system (GPS) 6, an on-board position detection and control subsystem 8, a hydraulic actuator subsystem 10, and a ballast discharge mechanism 12 (FIG. 4).

The GPS 6 (FIG. 1) includes a satellite constellation 14 comprising a number of individual satellites whose positions are continuously monitored. The satellites transmit signals, including positioning data, which can be received by differential GPS stations 16 located in fixed positions and by GPS receivers, such as the on-board vehicle receiver 18, which are typically mobile. The differential GPS stations may also be in relatively "fixed" positions, such as in geo-stationary orbits. Various other configurations and arrangements of global positioning systems can be employed with the present invention. The differential GPS station 16 receives signals from the satellite constellation 14 and transmits signals to which may be received by mobile GPS receivers.

Figure 2:
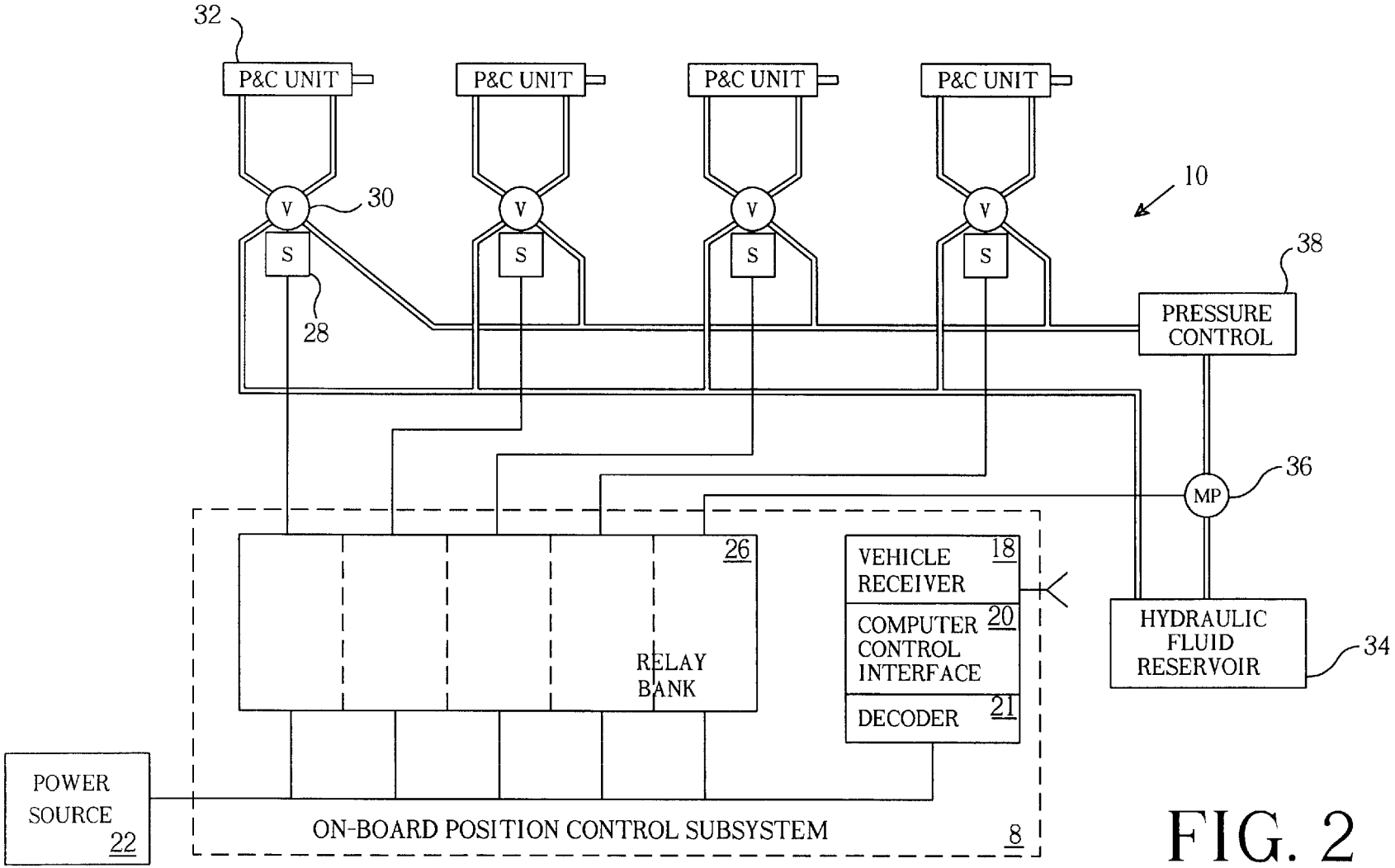
FIG. 2 is a diagrammatic view of a hydraulic actuator subsystem for operating ballast hopper doors of the ballast spreading system.

The on-board position control subsystem 8 (FIG. 2) is mounted on the railcar and includes the GPS vehicle receiver 18, which receives signals from conventional GPS stations 14 and a differential GPS station 16 and calculates geographic coordinates of the receiver 18. The vehicle receiver 18 can comprise any of a number of suitable mobile receiver units or OEM (original equipment manufacturer) GPS receiver components which are commercially available.

The vehicle receiver 18 is connected to a control computer 20 which receives positioning data signals from the vehicle receiver 18, processes same and interfaces with the actuator subsystem 10. The control computer 20, also referred to herein as a head end controller (HEC) can, for example, be a fairly conventional desktop or laptop type of personal computer, preferably with typical capabilities in currently available computers of this type.

The controller 20 includes decoder circuitry 21 which receives command signals addressed to specific hydraulic actuators or piston/cylinder units 32 in the actuator subsystem 10. The output of the decoder 21 is input to a relay bank 26 with multiple relays corresponding to and connected to respective components of the hydraulic actuator subsystem 10. The position control subsystem 8 is connected to a suitable, on-board electrical power source 22, which can utilize a solar photovoltaic collector panel 24 for charging or supplementing same. Alternatively, the power source 22 may be a conventional DC charging bus, as is found on conventional trains for powering electrical subsystems on railroad cars.

The hydraulic actuator subsystem 10 (FIG. 2) includes multiple solenoids 28 each connected to and actuated by a respective relay of the relay bank 26. Each solenoid 28 operates a respective hydraulic valve 30. The valves 30 are shifted between extend and retract positions by the solenoids 28 whereby pressurized hydraulic fluid is directed to the piston/cylinder units 32 for respectively extending and retracting same. The piston/cylinder units 32 can comprise two-way hydraulic units, pneumatic units, or any other suitable actuators. A hydraulic fluid reservoir 34 is connected to the valves 30 through a suitable motorized pump 36 and a pressure control 38.

Figure 3:
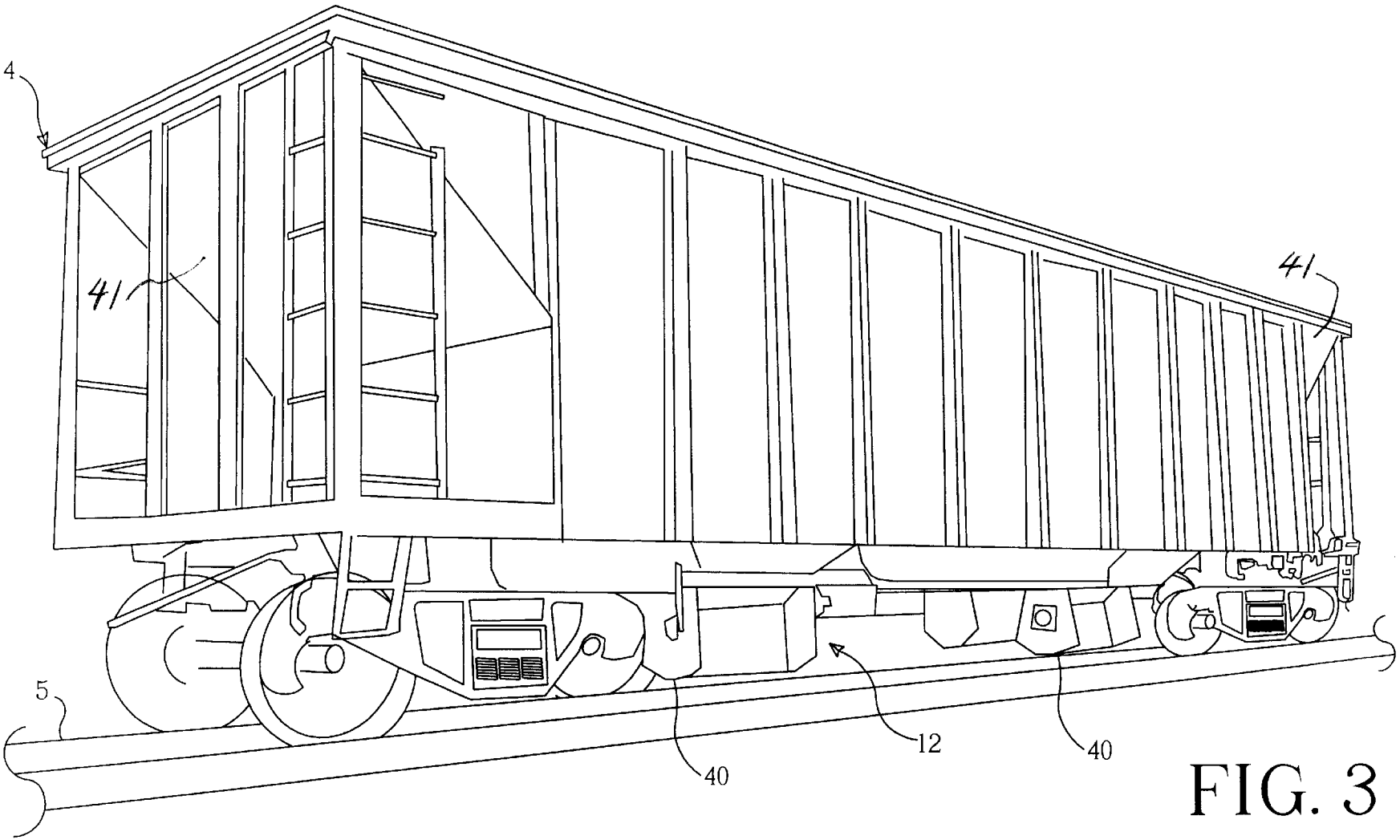
FIG. 3 is a perspective view of a ballast hopper car for use in the present invention.

The ballast discharge mechanism 12 (FIG. 4) includes four hopper door assemblies 40 installed on the underside of the hopper car 4 and arranged two to each side. The ballast hopper car 4 includes front and rear hoppers 41 (FIG. 3), each with left and right discharge chutes 42. A hopper door assembly 40 is installed at each discharge chute 42 and controls the flow of ballast 44 (FIG. 15) therefrom. The hopper door assemblies 40 discharge the ballast 44 laterally and are adapted to direct the discharge inboard (toward the center of a rail track 5 between the rails) or outboard (toward the outer edges of the rail track 5). A more detailed description of the construction and function of the hopper door assemblies 40 can be found in U.S. Pat. No. 5,657,700, which is incorporated herein by reference. As shown in FIG. 4, each hopper door assembly 40 is operated by a respective hydraulic actuator 32 for selectively directing the flow of ballast 44 therefrom.

As will be described in more detail below, the position control subsystem 8 is preprogrammed with various data corresponding to the operation of the logistic system 2. For example, discharge operations of the ballast discharge mechanism 12 can be programmed to occur at particular locations. Thus, ballast 44 can be applied to a particular section of rail track 5 by inputting its GPS coordinates and programming the position control subsystem 8 to open the hopper door assemblies 40 in the desired directions and for predetermined durations. The GPS signals received by the on-board position control subsystem 8 can provide relatively precise information concerning the position of the hopper car 4.

The reference numeral 102 generally designates a modified embodiment of a ballast spreading control system including a modified embodiment of the present invention which employs a linear movement-based position control subsystem 104. The position control subsystem 104 can comprise any suitable means for measuring the travel of a vehicle, such as the railcar 4, and/or detecting its position along the rail track 5 or some other travel path.

The position control system 104 includes a computer 106 which interfaces with an optional coarse or rough position detector 108 for detecting rough position markers 110. For example, the rough position markers 110 can be located alongside the rail track 5 whereby the rough position detector 108 provides a signal to the computer 106 when the railcar 4 is positioned in proximity to a respective rough position marker 110. The position control subsystem 104 can also include a suitable linear distance measuring device for measuring travel. For example, an encoder/counter 112, such as a mechanical or electrical odometer, can be mounted on the railcar 4 for measuring distances traveled by same or for counting revolutions of a railcar wheel 114. The encoder/counter 112 can be connected to a travel distance converter 116 which provides signals corresponding to travel distances to the computer 106. The computer 106 can interface with an hydraulic actuator subsystem 10, such as that described above, to control the discharge of ballast 44 therefrom in relation to the detected position.

The material applying or ballast spreading systems 2 and 102 described above are principally directed to controlling the material spreading activities of a single rail car under position coordinate control by a computer. While a ballast spread by a single car, or several such cars, can provide some utility in relatively small operations, such as small scale maintenance operations. However, rail maintenance is often a very large undertaking, involving hundreds or thousands of miles of tracks on a recurring basis. The present invention is adaptable to such larger scale rail maintenance operations.

Figure 12:
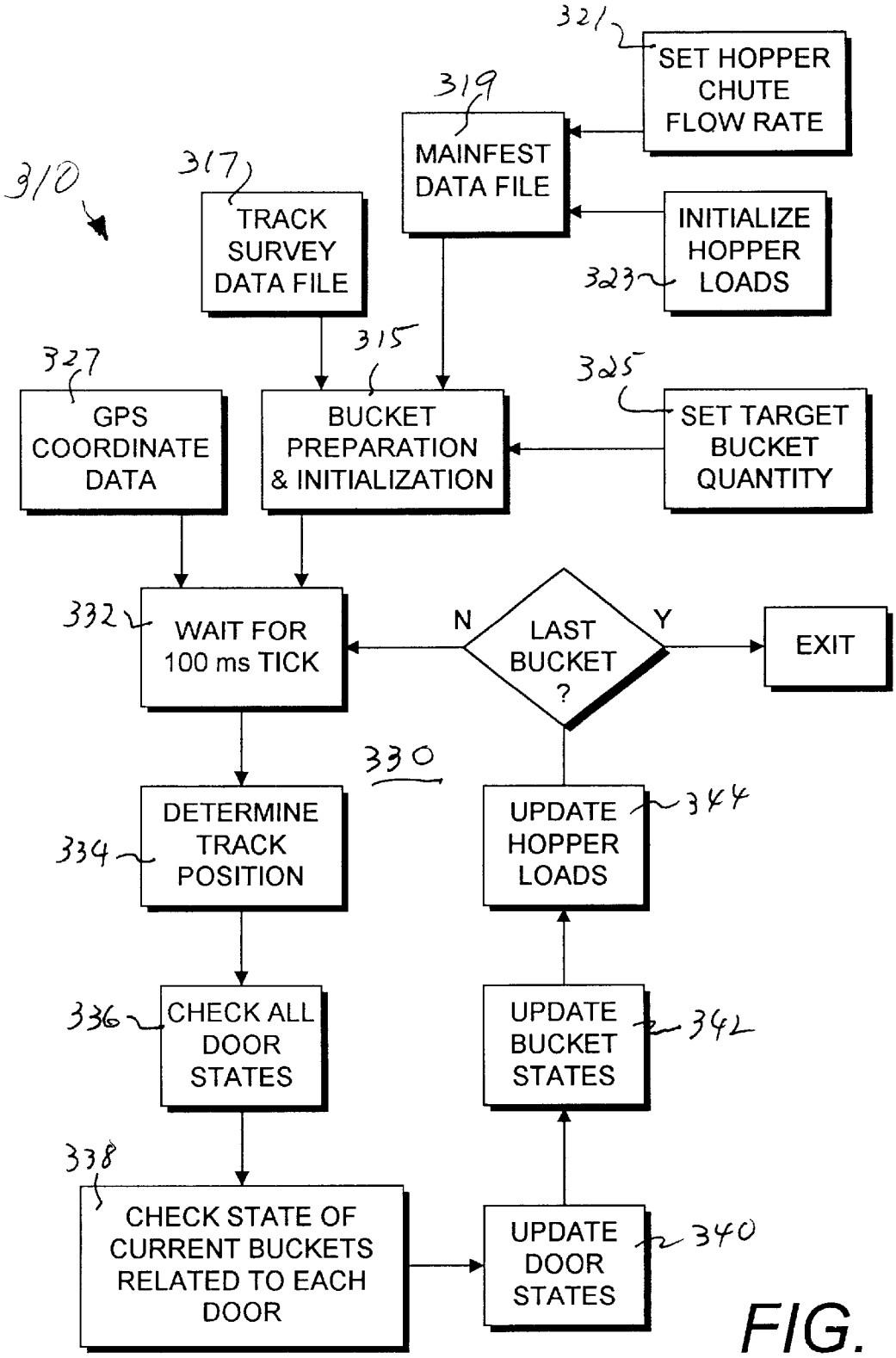
FIG. 12 is a flow diagram illustrating the principal functions of a ballast spreading control process of the present invention.
Figure 13:
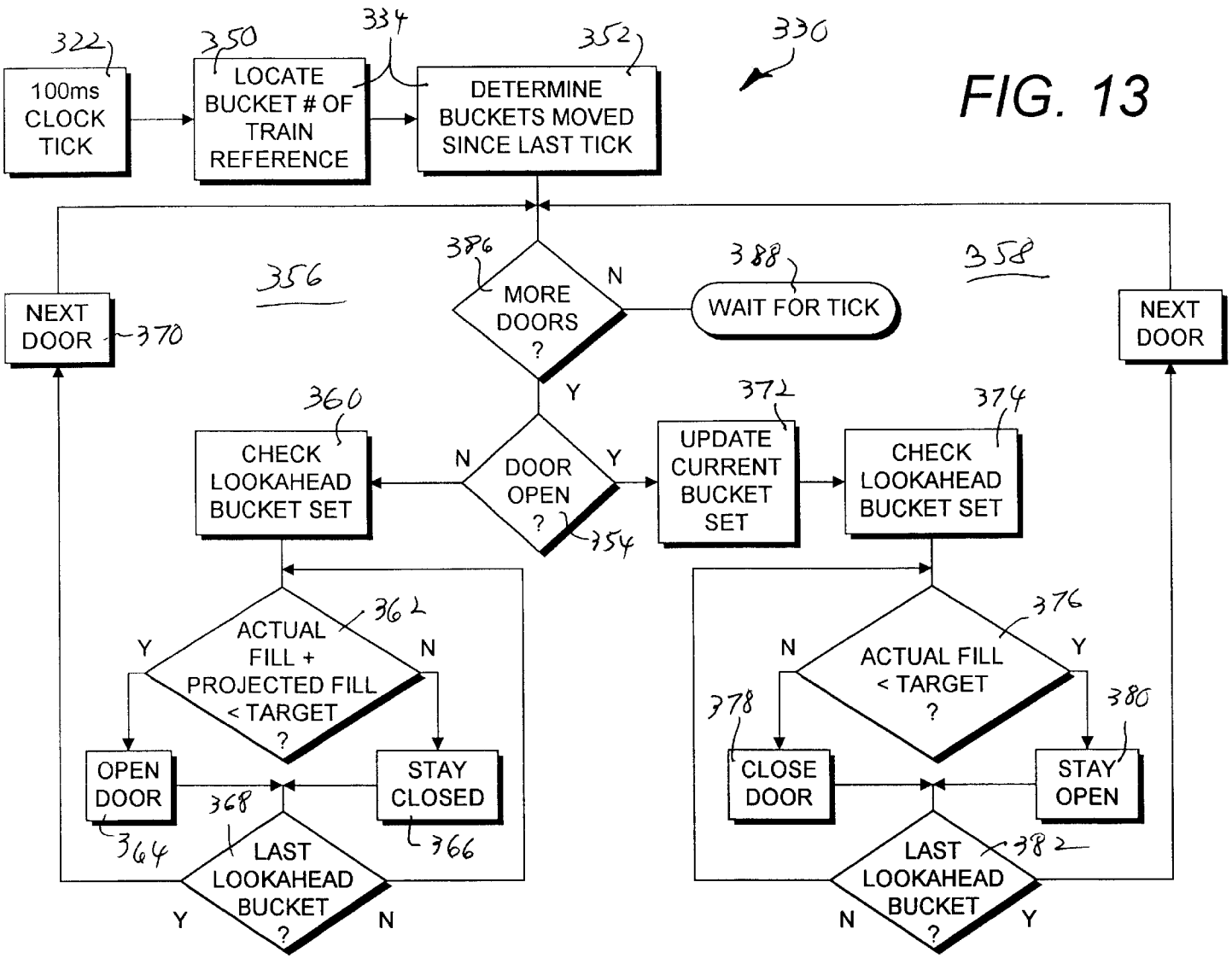
FIG. 13 is a flow diagram illustrating in more detail than FIG. 12 the principal functions monitored and actions taken in the ballast spreading control process of the present invention.
Figure 14:
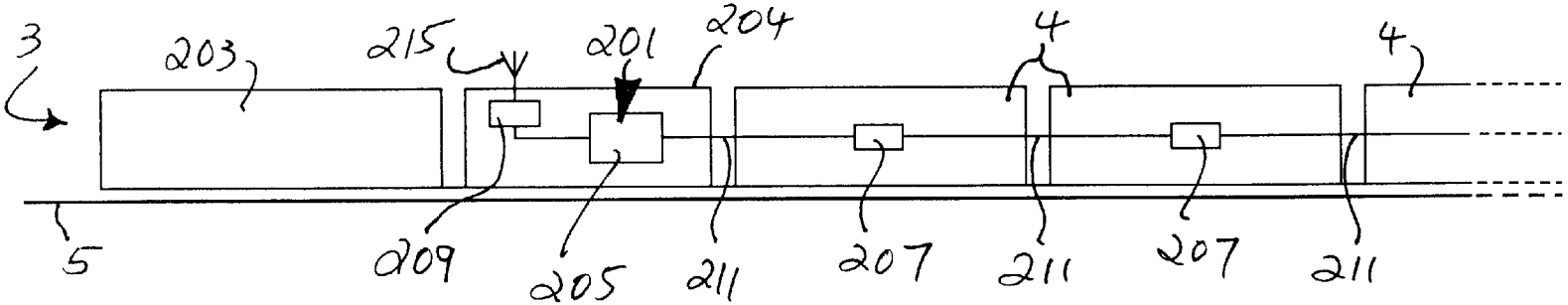
FIG. 14 is a diagrammatic representation illustrating a ballast train for use in practice of the ballast spreading system of the present invention.
Figure 15:
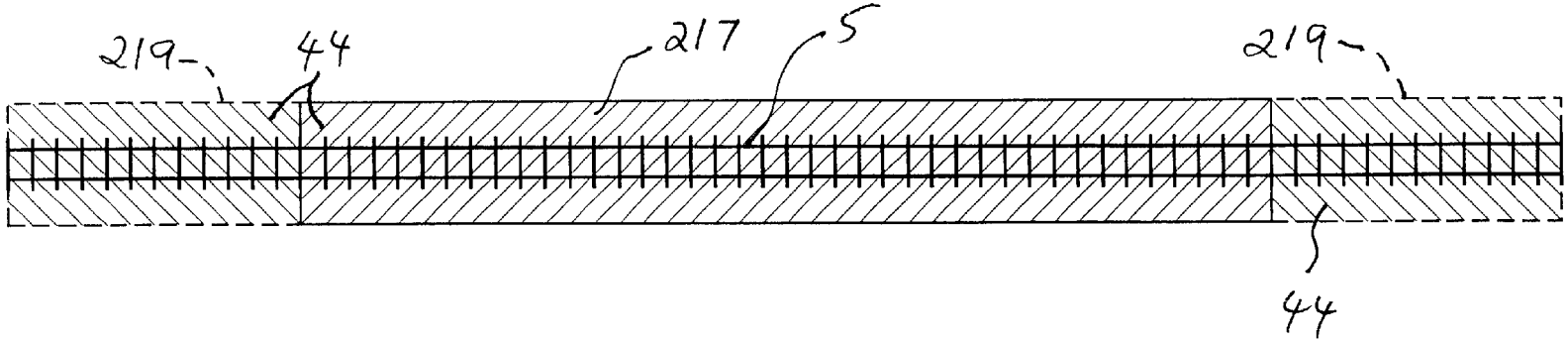
FIG. 15 is a diagrammatic representation illustrating a railroad track and spread sections intended to receive ballast spread by the present invention and no-spread sections which are not to receive such ballast.

FIGS. 6–15 illustrate a preferred embodiment of the GPS controlled multiple source material application system or ballast spreading system 201 of the present invention. Referring to FIGS. 14 and 15, the system 201 includes a ballast train 3 including a locomotive 203, a control car 204, and a plurality of ballast hopper cars 4, as described above, positioned on a railroad track 5. A typical ballast train 3 may include fifty hopper cars 4. The system 201 includes a main computer or head end controller (HEC) 205, a plurality of car control units (CCU) 207, a differential GPS receiver 209, and a network 211 interconnecting the HEC 205 with the CCU's 207. The GPS receiver 209 is interfaced to the HEC 205 and has a GPS antenna 215 which forms a spatial reference of the ballast train 3. Referring to FIG. 15, the system 201 is adapted for controlled and coordinated spreading ballast 44 (represented by cross-hatching in FIG. 15) in spread zones 217 and inhibiting the spreading of ballast 44 in no-spread zones 219, according to positions detected by the GPS receiver 209.

The GPS receiver 209 is a conventional differential GPS receiver or receiver component, as available from a number of manufacturers. The GPS receiver 209 outputs position data, such as latitude and longitude coordinates, in a format which can be further processed by the HEC 205. Further details of the,GPS receiver 209, and satellite based global positioning systems, will not be described herein since such details are readily available to those skilled in the appropriate arts.

The HEC 205 may be a desktop or laptop type of personal computer. Currently available personal computers based on Pentium III (Intel) or AMD Athlon (American Micro Devices) class of microprocessors, or better, are adequate for use as the HEC 205, although not specifically required.

The network 211 may be any suitable type of computer network to allow communication between the HEC 205 and the CCU's 207, and possibly the GPS receiver 215. In the system 201, the network 211 is preferably based on the Lontalk and Neuron components and protocols of Echelon Corporation of Palo Alto, Calif. The network 211 may be a relatively low bandwidth network since only low data density control commands, status reports, and the like are required to be carried. Alternatively, other types of networks and communication protocols may be suitable for use in the system 201.

Figure 6:
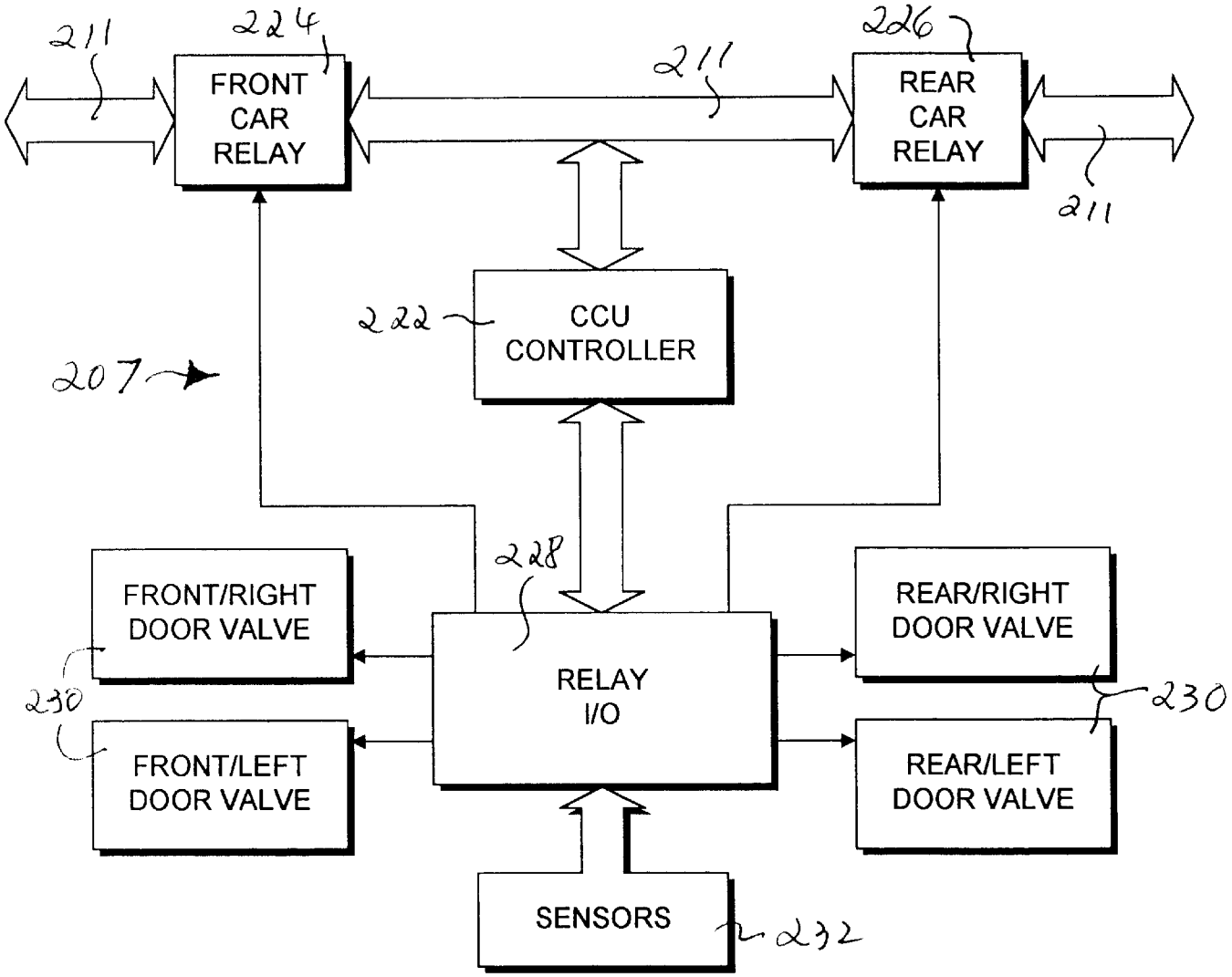
FIG. 6 is a block diagram illustrating principal components of a car control logic unit (CCU) which is installed on each hopper car of the present invention.

FIG. 6 illustrates further details of a typical car control unit or CCU 207. The CCU 207 includes a CCU controller 222 which may include a microprocessor or microcontroller in addition to other logic components and circuitry. The CCU controller 222 is connected by a parallel interface to the network bus 211 which, as illustrated, is interrupted by front and rear car communication relays 224 and 226, which are normally closed to enable data communication therethrough. The CCU controller 222 is also interfaced through relay input/output logic 228 to hydraulic valves 230 which control operation of the front and rear sets of right and left hydraulic actuators 32, which operate the ballast hopper doors 40. The relay I/O logic 228 may also receive inputs from sensors 232 on the car 4, such as door status switches, hydraulic pressure switches, and the like (not shown). As shown, the CCU controller 222 is interfaced through the relay I/O logic 228 to the car relays 224 and 226, also referred to as wireline relays, and is able to selectively open the relays 224 and 226 for a purpose which will be detailed further below.

The CCU controller 222 is programmed for certain automatic functions, such as "dead man" type functions wherein the CCU controller 222 causes the associated ballast doors 40 to close after a communication timeout in which no data communications are received by the CCU controller 222 from the HEC 205. This is a safety feature which causes the cessation of ballast spreading or prevents the initiation of ballast spreading in the event of loss of control communication.

Figure 7:
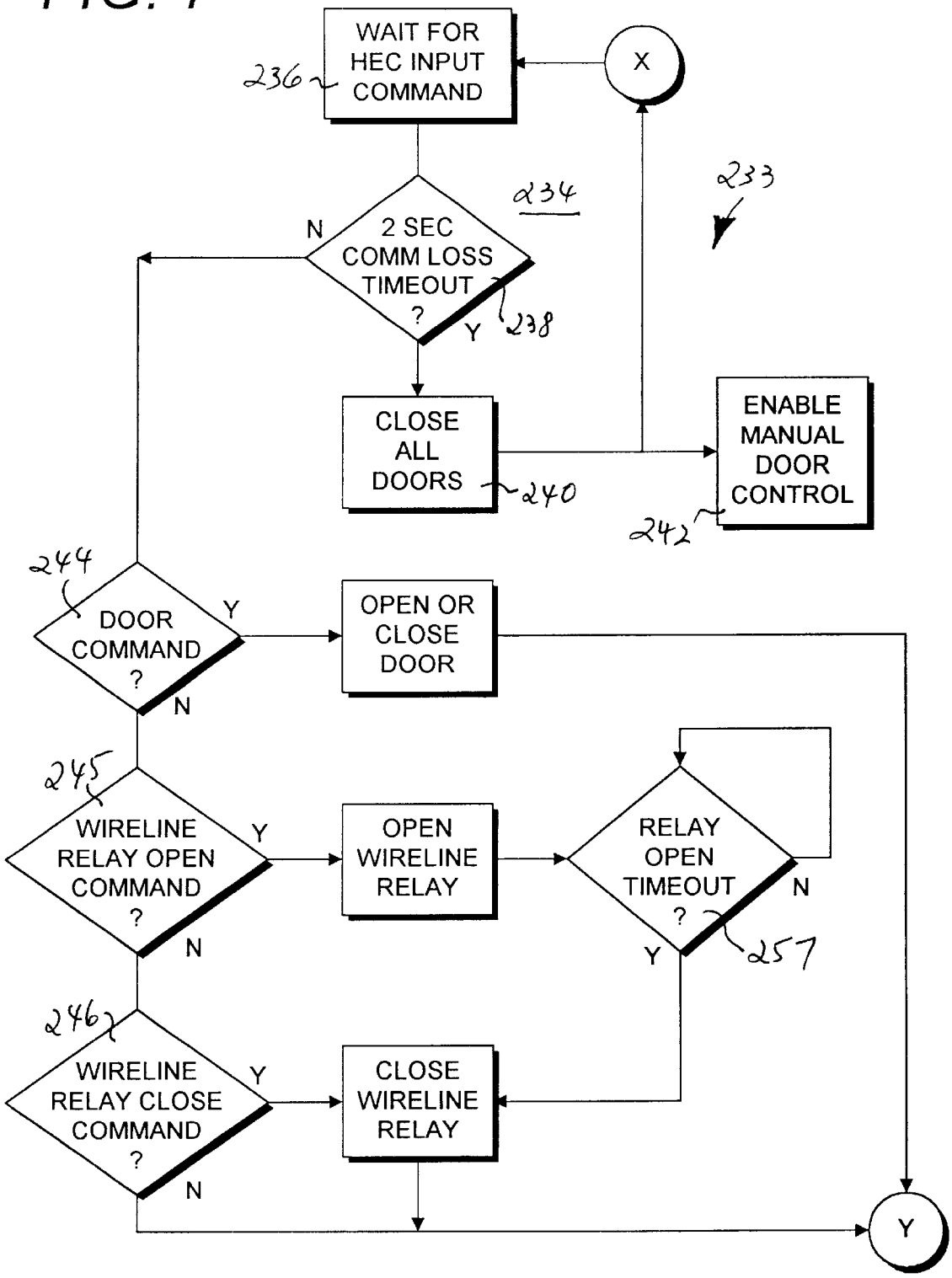
FIGS. 7, 8, and 9 are interrelated flow diagrams which illustrate respective portions of the principal control functions of the car control unit (CCU) present on each hopper car of the present invention.
Figure 8:
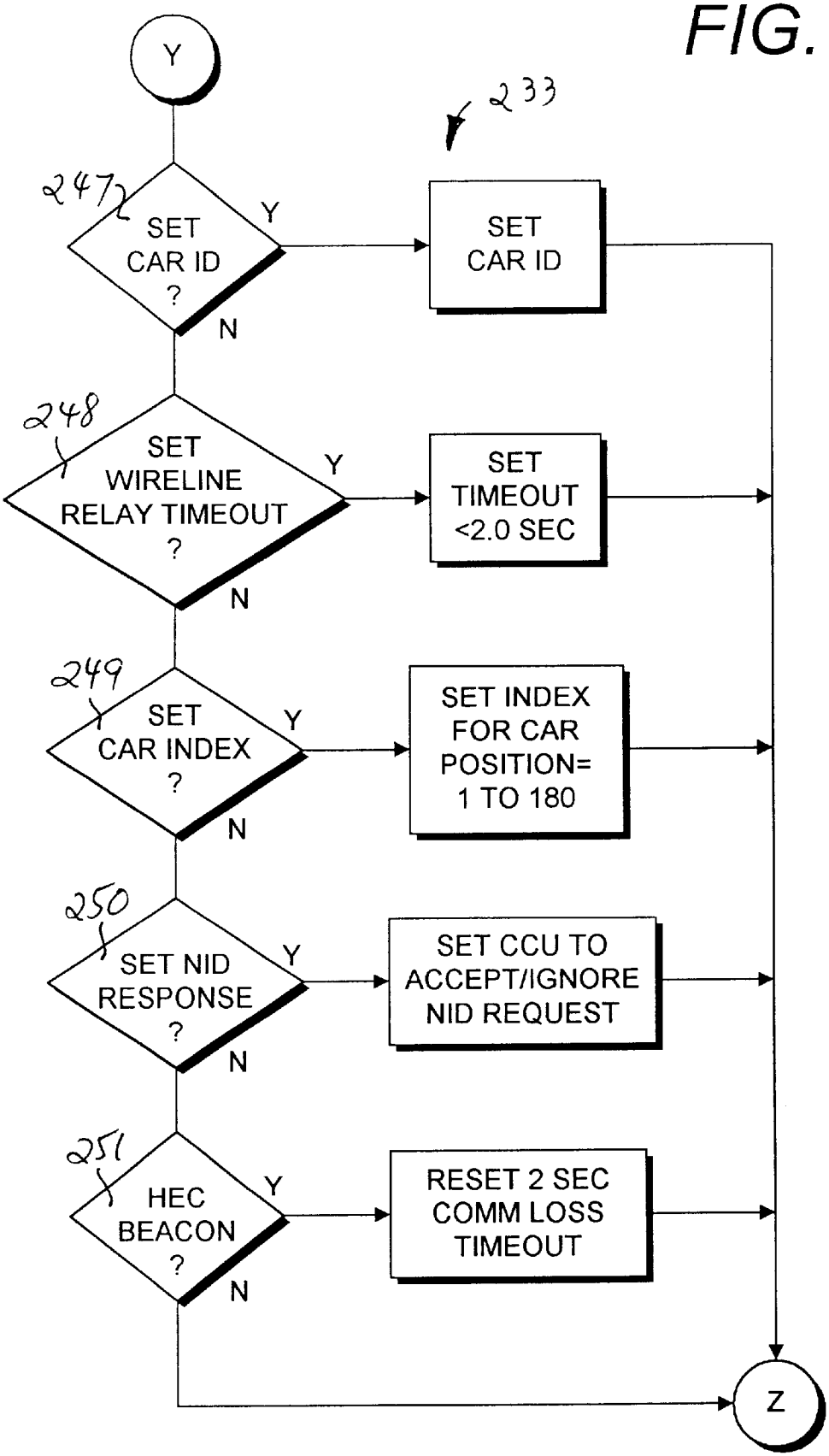
Figure 9:
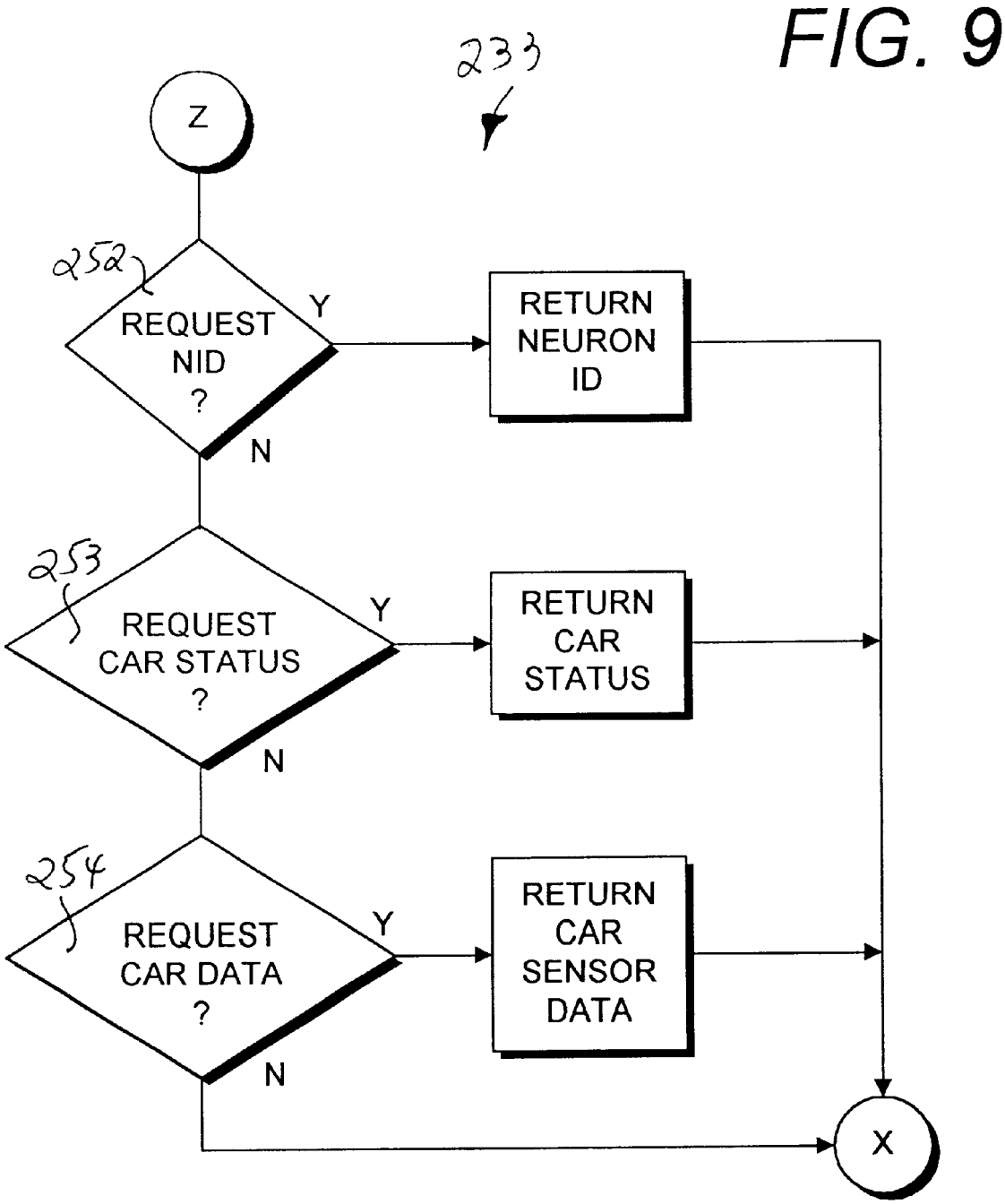

FIGS. 7, 8, and 9 illustrate the principal software functions 233 of the CCU controller 222. Referring to FIG. 7, a hopper car "dead man" loop 234 is shown in which the CCU 222 waits for any command from the HEC 205 at 236 for a two second communication timeout at 238. If no command is received, all ballast doors 40 are closed at 240, manual control of the doors 40 is enabled at 242, and control is returned to the wait function at 236 through entry point X. If received before the 2 second timeout at 238, the CCU controller 222 can process a door command at 244, a wireline or car relay open commmand at 245, a wire relay close command at 246, a set car ID (identification) command at 247, a set wireline relay timeout command at 248, a set car index command at 249, a set NID (Neuron ID) response command at 250, an HEC beacon command at 251, a request NID command at 252, a request car status command at 253, or a request car data command at 254. Although the commands 244 through 254 are shown in a sequence, the CCU controller 222 merely waits for one of the commands and processes it. Additionally, the connection or entry points X, Y, and Z are for graphic convenience.

Referring to FIG. 7, the wireline open command includes a timeout function at 257. Whenever the car or wireline relays 224 or 226 are opened, the timeout function 257 closes it after a timeout interval, set through the timeout interval set function 248, to re-enable communication therethrough. Although only one set of wireline relay commands is shown, in actuality the CCU controller 222 is able to process either front or rear wireline commands. The car index command 249 is used set the sequential position of a car 4 on the ballast train 3. The HEC beacon command 251 is normally broadcast periodically to all cars CCU's 207 at an interval of less than the two second dead man timeout interval to maintain the status quo of all functions. Thus, if a CCU 207 receives no other commands, it will periodically receive the HEC beacon 251. The remaining CCU functions 233 are either self-explanatory or will be referred to in more detail below.

Figure 10:
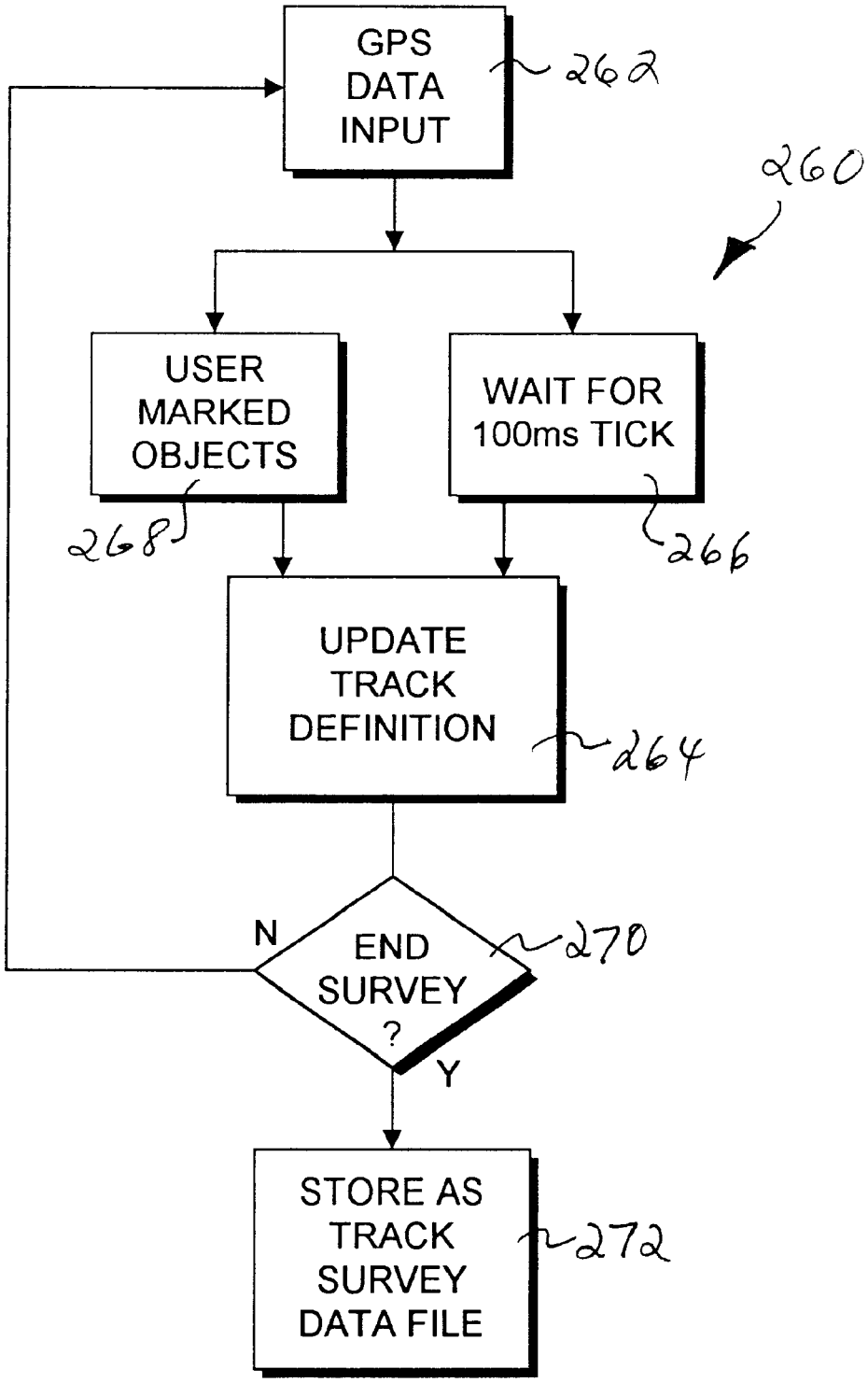
FIG. 10 is a flow diagram illustrating principal functions of a track survey routine of the present invention.
Figure 11:
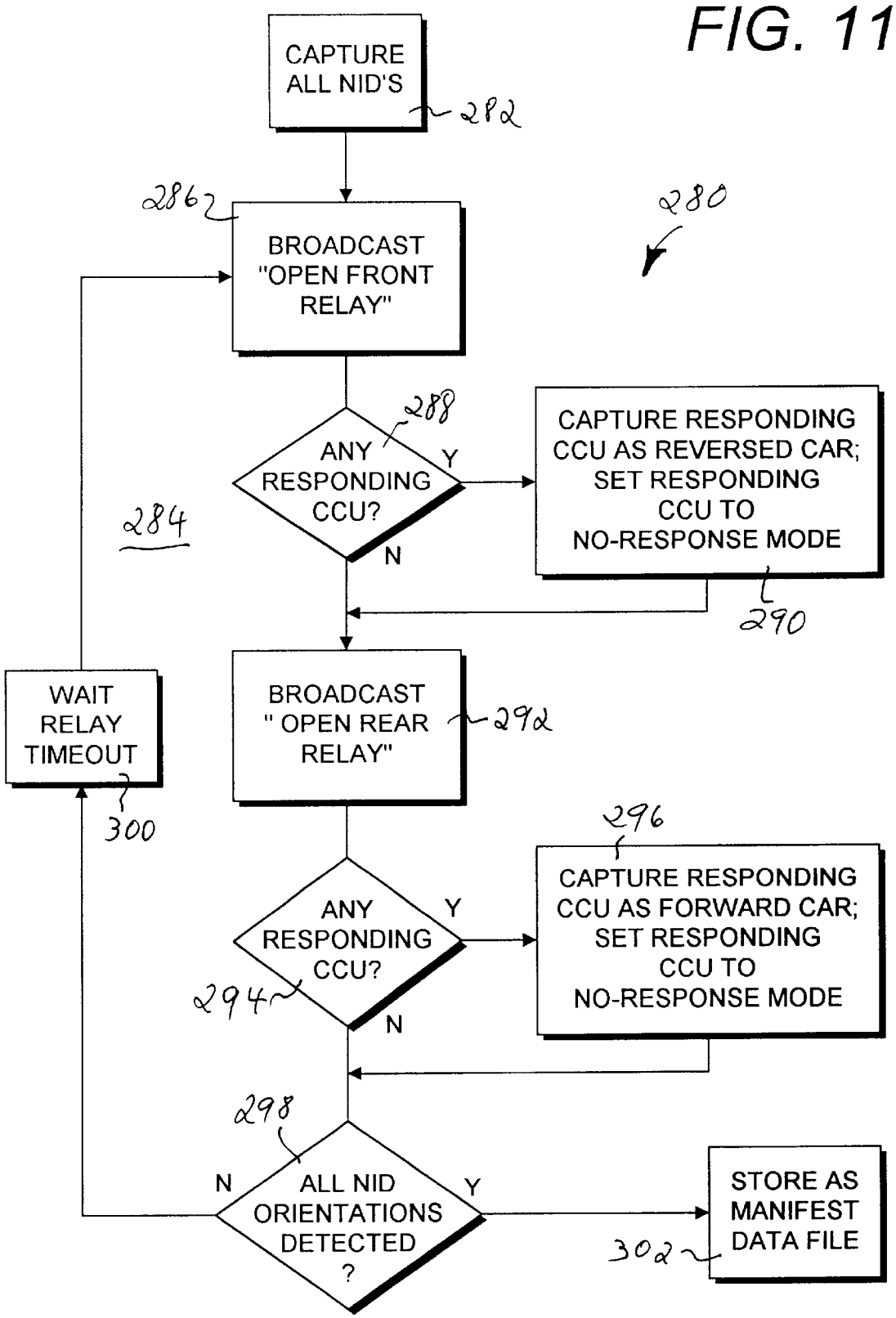
FIG. 11 is a flow diagram illustrating principal functions of a ballast train manifest routine of the present invention.

FIG. 10 illustrates a track survey process 260 for obtaining GPS coordinates for the spread zones 217 and no-spread zones 219 by surveying the track 5. The process 260 may be carried out, for example, using a small vehicle such as a Hy-Rail vehicle which is driven along the track 5 with a differential GPS receiver and a computer, such as the receiver 215 and HEC 205, on board. The process 260 receives GPS coordinate data at 262 from the receiver 215 and updates the track definition data at 264 at 100 millisecond intervals determined by loop timer at 266. At any time, the roadmaster or other operator conducting the survey may toggle a switch to indicate a change from a spread condition to a no-spread condition at 268. The process 260 continues until it detects a command from the operator at 270 to end the survey process 260. At that time, the geographic coordinate data gathered is stored in a track survey data file at 272.

For the most part, the survey process 260 can gather all the required location data to conduct a ballast spreading run. In some circumstances, it may be necessary to conduct parts of the survey on foot to mark starting and ending locations of spread zones or no-spread zones. Additionally it may be necessary to mark some zones which are not appropriate for ballast spreading using the system 201. For example, if multiple transitions from spreading to non-spreading status would be required, there may not be enough time to cycle the hydraulic actuators 32 because of lags in hydraulic fluid supply. In such circumstances, it may be necessary to spread ballast on such a zone by more conventional techniques.

In order to control the individual ballast doors 40 of the cars 4, it is necessary for the HEC 205 to "know" the position of each door 40 relative to the reference point 215 and to be able to "talk" to or communicate with each individual hydraulic actuator 32. The system 201 includes a train manifest process 280 (FIG. 11) for querying the CCU's 207 to determine the order of the cars 4 and their forward or reversed orientation. The process 280 initially captures all the Neuron ID numbers (NID's) at 282 by broadcasting the request NID command 252 (FIG. 9). The first CCU 207 to respond is placed in a non-responsive mode by the set NID response command 250 (FIG. 9). The capturing routine 282 is repeated until no more responses are received. By the routine 282, the HEC 205 is able to identify all the cars 4 with functioning CCU's 207.

Next, a car sequence/orientation survey loop 284 is executed. In the loop 284, the front car relay 224 and rear car relay 226 are sequentially opened, checks made for any responding CCU's 207, and setting any responding CCU to a no response state. At 286, the command is broadcast to all CCU's to open their front relay 224. A command for any CCU to respond at 288 is made. Any CCU which responds with its front relay 224 open is determined to be reversed. At step 290, the car 4 with the responding CCU 207 is designated as the first in line and as reversed in orientation and is set to the no-response mode. If no response was detected from step 286, the command is broadcast at 292 to for all CCU's to close their rear car relays 226. A test is made at 294 for any responding CCU. If so, the car 4 with the responding CCU 207 is determined at 296 to be forwardly oriented, its Neuron ID is stored as the first car 4, and the CCU responding is set to no-response mode. At test 298, if all CCU's 207 have not been identified and the orientation of their cars 4 determined, the loop 284 returns control to step 286 through a relay timeout wait step 300. The loop 284 is repeated until all CCU's 207 which were identified in step 282 have been processed as to their sequential order and orientation. When that happens at 298, the manifest data is stored as a manifest data file at 302.

FIG. 12 illustrates the principal control functions of the system 201 in controlling the spreading of ballast 44 along the track 5. In the system 201, the length of surveyed track is divided into track unit lengths or "buckets". The size of the buckets is arbitrary; however, in an exemplary embodiment of the system 201, the buckets are equal to one foot lengths of the track 5. It should be noted that the type of ballast doors 40 employed in the present invention can be opened inboard or outboard, but not both ways simultaneously. Thus, if it is desired to spread ballast both between the rails and outside the rails, it is then necessary to track the activities in relation to two parallel sets of buckets, inboard buckets and outboard buckets. However, in some maintenance practices, particularly those in which subsequent activities involve lifting the rails and ties to position the deposited ballast, it is only necessary to spread outside the rails. For illustrative purposes, the system 201 will be described in terms of a single set of buckets.

In the ballast spreading control process 310 shown in FIG. 12, a bucket preparation and initialization set 315 receives the track survey data file 317 and the ballast train manifest data file 319. The manifest file 319 has been initialized with the average flow rate of ballast through the opened ballast doors at 321 and with the initial hopper ballast loads at 323. The bucket initialization step 315 also receives a user input target bucket quantity 325 which may actually be derived from a tons per mile entry. The target bucket quantity 325 is the amount of ballast per foot of a track to be applied in the spread zones 217. The bucket in no-spread zones 219 are initialized as full while the buckets in spread zones 217 are initialized at zero, or at another appropriate value if data has been inherited from a previous ballast spreading run. The process receives current geographic coordinate data 327 from the GPS receiver 209, which is referenced to the GPS antenna 215. Distances to each ballast door 40 are determined in relation to the train reference point coincident with the antenna 215.

The illustrated ballast spread control process 310 initiates a ballast spread control loop 330 at 100 millisecond or tenth of a second intervals, as shown by the wait step 332. During each loop 330, the HEC 205 determines a reference track position at 334, based on the GPS data, checks the state of all ballast doors 40 at 336, checks the state of buckets at 338 which can be affected by a door 40 currently being checked, updates all the door states at 340 by either maintaining the status quo orchanging the state as required by conditions detected or calculated, updates all bucket states at 342 which have changed by addition of ballast 44. The control loop 330 continues until a test at 346 detects that the last bucket has been passed by the ballast train 3, at which point control exists at 348 from the ballast spread control process 310.

FIG. 13 shows additional details of the ballast spread control loop 330. As part of determining the current track position 334 at a clock tick 322, the current bucket number that the train reference 215 coincides with is determined at step 350 and a determination of the number of buckets moved since the last tick is made at 352. The steps 350 and 352 enable a determination of train speed and shifts the sets of buckets referenced at each door state check 336 (FIG. 12). The process 310 focuses on sets of buckets whose state of fill will be affected by the current state or potential change of state of a current ballast door 40 being checked.

The actual door state test at 354 determines if each ballast door 40 is currently open or closed. Depending on the detected state of the current door 40, the process 330 will enter a closed door loop 356 or an open door loop 358.

If the current door is closed, the closed door loop 356 checks a lookahead set of buckets at 360. The lookahead set of buckets are buckets positioned at such a distance ahead of the current door that, at the currently detected train speed and with the known response lag of the actuator 32, a change in door state "now" will begin to affect such lookahead buckets. The loop 356 considers a set of lookahead buckets since a given processing interval and train speed may so require. The set may also comprise a single bucket. The loop 356 calculates at 362 whether the current or actual fill of the test bucket plus a project fill from opening the current door would be less than the target fill for the bucket. If so, the current door 40 is opened 364; if not it stays closed at 366. All buckets in the current lookahead set are processed until a test at 368 determines that the last bucket has been processed. Afterwards, the loop 356 advances to the next door at 370.

If a door is detected as open at 354, the states of fill of a set of buckets which will receive ballast from the currently open door in the current clock tick interval are updated at 372. Afterward, the door open loop 358 is somewhat similar to the door closed loop 356 and includes a fill test 376 which determines if the actual fill of the lookahead buckets is less than the target fill. If not, that is the target is currently exceeded, the current door 40 is closed at 378. If the test 376 is true, the door stays open at 380. The lookahead loop exits at 382 when the last lookahead bucket for the current door 40 has been processed. Then the loop 358 proceeds to the next door at 384. When the last door has been checked, as indicated by the test 386, the process 330 waits for the next clock tick at 388.

The door open loop 358 allows some overfill of the buckets. As a practical track maintenance matter, this is preferable to not enough ballast available. However, it is highly undesirable to spread ballast in a no-spread zone 219, which may be a road crossing. Such an occurrence may constitute a road traffic hazard. For this reason, buckets in the no-spread zones always causes the current door 40 to be closed at 378.

The logic of the closed loop fill test 356 is designed to cause multiple ballast doors 40 to open if appropriate to quickly fill the desired buckets. It is desirable to maximize the number of filled buckets in the system 201 rather than partially fill a larger number of buckets.

As the ballast is depleted from hoppers 41, they are bypassed in processing and more rearward hoppers 41 are activated. Thus, ballast spreading proceeds from the forward hoppers 41 to the more rearward hoppers.

It is to be understood that while certain forms of the present invention have been illustrated and described herein, it is not to be limited to the specific forms or arrangement of parts described and shown.

What is claimed and desired to secure by letters patent is:

1. A method for selectively applying a bulk material to a surface from a group of interconnected containers moving on said surface in a direction of movement and having a GPS antenna and respective controllable bulk material dispenser positioned one after another along said direction of movement, said method comprising the steps of:

(a) establishing a reference location of said containers and a respective distance from said reference location to each of said material dispensers;

(b) detecting application geographic coordinates of sections of said surface onto which said material is to be applied;

(c) storing the application coordinates in a computer which is interfaced to said material dispensers in such a manner as to control operation of said material dispensers to dispense said bulk material;

(d) transporting said group of interconnected containers on said surface;

(e) detecting current geographic coordinates of said GPS antenna during said transporting and said computer calculating respective geographic coordinates of each of said material dispensers from said reference location; and (f) upon the current geographic coordinates of at least one of said material dispensers correlating with said application coordinates, said computer controlling said at least one of said material dispensers to activate same to thereby apply said material to said surface.

2. A method of selectively spreading ballast along a railroad track (a) providing a railroad car with a load of ballast and a ballast door with a ballast door motor controllable to open said ballast door to enable spreading of said ballast and to close said door to prevent spreading said ballast;

(b) detecting spread geographic coordinates of spread sections of said track on which said ballast is to be spread using a satellite based global positioning system;

(c) detecting no-spread geographic coordinates of no-spread sections of said track on which said ballast is not to be spread using a satellite based global positioning system;

(d) storing the spread coordinates and the no-spread coordinates in a computer interfaced to said door motor;

(e) transporting said railroad car along said track;

(f) periodically detecting current geographic coordinates of said ballast door using a satellite based global positioning system;

(g) upon the current coordinates correlating with said spread coordinates, said computer controlling said door motor to open said ballast door to enable spreading said ballast; and (h) upon the current coordinates with said no-spread coordinates, said computer controlling said door motor to close said ballast door to disable spreading said ballast.

3. A method as set forth in claim 1 and including the step of:

(a) detecting said application coordinates using a satellite based global positioning system.

4. A method as set forth in claim 1 and including the step of:

(a) detecting said current geographic coordinates of said reference location using a satellite based global positioning system.

5. A method as set forth in claim 1 and including the steps of:

(a) setting in said computer a target unit application quantity equal to a desired quantity of said material applied to a selected unit of area of said surface;

(b) said computer maintaining a stored record of a previous quantity of material applied to each unit of area of said surface;

(c) upon said computer activating one of said material dispensers, said computer calculating a projected quantity of said material which will be applied to an upcoming unit of area of said surface by activating an additional one of said material dispensers; and (d) upon a sum of said previous quantity and said projected quantity not exceeding said target unit application quantity, said computer activating an additional one of said material dispensers.

6. A method of selectively spreading ballast along a railroad track and comprising the steps of:

(a) providing a plurality of railroad cars, each with a load of ballast and having a ballast door with a ballast door motor controllable to open said ballast door to enable spreading of said ballast and to close said door to prevent spreading said ballast;

(b) detecting spread geographic coordinates of spread sections of said track on which said ballast is to be spread using a satellite based global positioning system;

(c) detecting no-spread geographic coordinates of no-spread sections of said track on which said ballast is not be spread using a satellite based global positioning system;

(d) storing the spread coordinates and the no-spread coordinates in a computer interfaced to each of said door motors;

(e) transporting said railroad car along said track;

(f) periodically detecting respective current geographic coordinates of each ballast door using a satellite based global positioning system;

(g) upon the current coordinates correlating with said spread coordinates, said computer controlling opening and closing of the ballast doors of one or more cars to thereby effect spreading of said ballast on said spread sections and inhibiting spreading of said ballast on said no-spread sections;

(h) upon the current coordinates correlating with said no-spread coordinates, said computer controlling said door motor to close said ballast door to disable spreading said ballast;

(i) entering into said computer a target ballast quantity per unit track length of said spread sections of said track;

(j) entering into said computer a ballast flow rate associated with said cars when a respective ballast door thereof is opened;

(k) calculating an applied percentage of said target ballast quantity which is applied to each unit of track length of said spread sections by ballast flowing through an open ballast door as said ballast door travels over each unit of track length of said spread sections;

(l) said computer controlling opening and closing of said ballast doors relative to detected positions of said ballast doors within said spread sections in such a manner as to apply said target ballast quantity per unit track length of said spread sections;

(m) said computer maintaining an updated record of an applied percentage of said target ballast quantity which has been applied to each unit of track length of said spread sections;

(n) periodically detecting a door state of each ballast door as open or closed;

(o) upon detecting a door state, said computer checking an applied percentage record associated with a lookahead unit of track length positioned at a selected distance ahead of the current ballast door which has most recently had its door state detected; and (p) said computer calculating if a change of door state of said current ballast door is required to increase said percentage said target ballast quantity of said lookahead unit of track length without exceeding said target ballast quantity.

7. A method of selectively spreading ballast along a railroad track and comprising the steps of:

(a) providing a ballast train including a plurality of ballast hopper cars, each car including a pair of ballast hoppers, each hopper having a load of ballast and including a ballast door and a ballast door actuator to position said door to control flow of said ballast therethrough, each car including car control logic circuitry, and said train including a main controller interfaced to each car control circuitry;

(b) entering into said computer, using a satellite based global positioning system, spread geographic coordinates of spread sections of a track on which ballast is to be spread and no-spread geographic coordinates of no-spread sections of said track on which ballast is not to be spread;

(c) said computer dividing said spread sections and no-spread sections into track length units;

(d) entering into said computer a target ballast quantity per track length unit to be applied to said spread sections;

(e) transporting said train along spread sections and said no-spread sections of said track;

(f) said computer maintaining an and updating a record of current percentage of said target ballast quantity associated with each track length unit of said spread sections and said no-spread sections of said track;

(g) periodically detecting geographic coordinates of each ballast door using a satellite based global positioning system and a ballast door state of being open or closed; and (h) upon detecting a door state of a current ballast door, said computer calculating if a change of said ballast door state is required to increase a percentage of said target ballast quantity for a selected set of said track length units without exceeding said target ballast quantity;

(i) detecting said geographic coordinates of said spread sections and said no-spread sections using a satellite based global positioning system;

(j) periodically detecting said geographic coordinates of each ballast door using a satellite based global positioning system.

8. A railroad ballast spreading system for distributing a selected quantity of ballast along selected sections of a railroad and comprising:

(a) a plurality of ballast hopper cars and a locomotive coupled to said cars to form a ballast train and operable to propel said cars along said railroad;

(b) each hopper car including a ballast hopper to hold quantity of ballast, a ballast chute communicating with said hopper and passing ballast therethrough at a measured flow rate, and a ballast door movable between an open position to enable flow of ballast through said chute to spread same and a closed position to inhibit said flow of ballast;

(c) each ballast door including a ballast door motor engaged therewith and selectively operable to urge said ballast door between said open position and said closed position;

(d) each ballast car including ballast car logic circuitry including address decode circuitry to decode a unique address associated with said ballast car and door motor control circuitry to control operation of said ballast door motor;

(e) position circuitry including a satellite based global positioning system and mounted on said ballast train and detecting current global positioning system geographic coordinates of a reference position on said train and periodically generating an updated location code representing said current geographic coordinates;

(f) a ballast control computer interfaced to each ballast car logic circuitry and said position circuitry and controlling spreading of ballast along said selected sections of said railroad by coordinated opening and closing of said ballast doors in relation to said location code; and (g) the system establishing a respective distance from said reference position on said train to each of said ballast cars for detecting the opening and closing location for said ballast doors in relation to said location code.

9. A system as set forth in claim 8 and including:

(a) a train speed measuring instrument mounted on said train and interacting with said railroad in such a manner as to generate a train speed code representing a speed of movement of said train along said railroad;

(b) said speed measuring instrument being interfaced to said computer; and (c) said computer controlling said spreading of ballast in relation to said train speed code.

10. A system as set forth in claim 8 and including:

(a) a train position encoder mounted on said train and interacting with said railroad in such a manner as to generate a train position code representing a relative location of said reference position along said railroad;

(b) said position encoder being interfaced to said computer; and (c) said computer alternatively controlling said spreading of ballast in relation to said train position code.

11. A method for selectively applying a bulk material to a surface from a group of interconnected containers moving on said surface in a direction of movement and having a GPS antenna and respective controllable bulk material dispensers positioned one after another along said direction of movement and moving on said surface, said method comprising the steps of:

(a) establishing a reference location of said containers and a respective distance from said reference location to each of said material dispensers;

(b) detecting application geographic coordinates of sections of said surface onto which said material is to be applied;

(c) storing the application coordinate in a computer which is interfaced interface to said material dispensers in such a manner as to control operation of said material dispensers said bulk material;

(d) transporting said group of interconnected containers on said surface;

(e) detecting current geographic coordinates of said GPS antenna during said transporting and said computer calculating respective geographic coordinates of each of said material dispensers from said reference location;

(f) upon the current geographic coordinates of at least one of said material dispensers correlating with said application coordinates, said computer controlling said at least one material dispensers to activate same to thereby apply said material to said surface;

(g) dividing said surface into a plurality of surface units of equal area;

(h) setting in said computer a target unit application quantity equal to a desired quantity of said material applied to each surface unit;

(i) said computer maintaining a respective stored record of a previous quantity of material applied to each surface unit;

(j) upon said computer activating one of said material dispensers, said computer calculating a projected quantity of said material which will be applied to an upcoming surface unit by activating an additional one of said material dispensers; and (k) upon a sum of said previous quantity and said projected quantity not exceeding said target unit application quantity, said computer activating an additional one of said material dispensers.

12. A method of selectively spreading ballast along a railroad track and comprising the steps of:

(a) providing a ballast train including a plurality of ballast hopper cars, each car including a pair of ballast hoppers, each hopper having a load of ballast and including a ballast door and a ballast door actuator to position said door to control flow of said ballast therethrough, each car including car control logic circuitry, and said train including a main controller interfaced to each car control circuitry;

(b) entering into said computer, using a satellite based global positioning system, spread geographic coordinates of spread sections of a track on which ballast is to be spread and no-spread geographic coordinates of no-spread sections of said track on which ballast is not to be spread;

(c) said computer dividing said spread sections and no-spread sections into track length units;

(d) entering into said computer a target ballast quantity per track length unit to be applied to said spread sections;

(e) transporting said train along spread sections and said no-spread sections of said track;

(f) said computer maintaining an and updating a record of current percentage of said target ballast quantity associates with each track length unit of said spread sections and said no-spread sections of said track;

(g) periodically detecting geographic coordinates of each ballast door using a satelite base d global positioning system and a ballast do or state of being open or closed;

(h) upon detecting a door state of a current ballast door state, said computer calculating if a change of said ballast door state is required to increase a percentage of said target ballast quantity for a selected set of said track length units without exceeding said target ballast quantity;

(i) each car including front and rear ballast hoppers, corresponding front and rear ballast doors, and corresponding front and rear door motors, and including the steps of:

(1) providing each car with respective car control logic circuitry interfacing said computer to the front and rear door motors of the associated cars, each car control circuitry having a unique car address code; and (2) said computer querying each car control circuitry for the associated car address code in such a manner as to determine a sequential order of said cars; and (j) said computer querying each car to determine a forward or rearward orientation of each car.

* * * * *